US007954178B2

(12) United States Patent
Durocher et al.

(10) Patent No.: US 7,954,178 B2
(45) Date of Patent: Jun. 7, 2011

(54) HOCKEY HELMET COMPRISING AN OCCIPITAL ADJUSTMENT MECHANISM

(75) Inventors: Jacques Durocher, St-Jérôme (CA); Jean-François Laperrière, Prévost (CA); Marie-Claude Généreux, Ste-Thérèse (CA); Denis Côté, St-Colomban (CA); Sébastien Lambert, Ste-Sophie (CA); Philippe Jean, Terrebonne (CA)

(73) Assignee: Bauer Hockey, Inc., Greenland, NH (US)

( * ) Notice: Subject to any disclaimer, the term of this patent is extended or adjusted under 35 U.S.C. 154(b) by 538 days.

(21) Appl. No.: 12/198,958

(22) Filed: Aug. 27, 2008

(65) Prior Publication Data

US 2010/0050323 A1 Mar. 4, 2010

(51) Int. Cl.
*A63B 71/10* (2006.01)
*A63B 13/015* (2006.01)
*A41D 13/00* (2006.01)

(52) U.S. Cl. ..... 2/425; 2/418; 2/421

(58) Field of Classification Search ..... None
See application file for complete search history.

(56) References Cited

U.S. PATENT DOCUMENTS

| | | | | | |
|---|---|---|---|---|---|
| 5,077,839 | A * | 1/1992 | Keller | 2/421 |
| 5,093,936 | A * | 3/1992 | Copeland et al. | 2/419 |
| RE34,699 | E * | 8/1994 | Copeland et al. | 2/419 |
| 5,898,950 | A | 5/1999 | Spyrou et al. | |
| 5,956,776 | A * | 9/1999 | Chartrand | 2/420 |
| 5,978,973 | A * | 11/1999 | Chartrand | 2/422 |
| 6,161,538 | A * | 12/2000 | Bonhomme et al. | 128/204.21 |
| 6,202,223 | B1 * | 3/2001 | Chartrand | 2/410 |
| 6,298,497 | B1 * | 10/2001 | Chartrand | 2/414 |
| 6,324,700 | B1 * | 12/2001 | McDougall | 2/417 |
| 6,385,780 | B1 * | 5/2002 | Racine | 2/414 |
| D496,762 | S * | 9/2004 | Durocher et al. | D29/122 |
| 6,966,075 | B2 * | 11/2005 | Racine | 2/425 |
| 6,968,575 | B2 * | 11/2005 | Durocher | 2/425 |
| 6,981,284 | B2 * | 1/2006 | Durocher | 2/425 |
| 7,765,608 | B2 * | 8/2010 | Durocher et al. | 2/9 |
| 2003/0135914 | A1 * | 7/2003 | Racine et al. | 2/413 |
| 2005/0034222 | A1 * | 2/2005 | Durocher | 2/425 |
| 2005/0034223 | A1 * | 2/2005 | Durocher | 2/425 |
| 2007/0060419 | A1 * | 3/2007 | Hutton | 473/446 |
| 2009/0044315 | A1 * | 2/2009 | Belanger et al. | 2/414 |
| 2009/0188022 | A1 * | 7/2009 | Durocher et al. | 2/414 |
| 2010/0050323 | A1 * | 3/2010 | Durocher et al. | 2/414 |

* cited by examiner

*Primary Examiner* — Bobby H Muromoto, Jr.

(57) ABSTRACT

A hockey helmet having an occipital adjustment mechanism for improving fit of the helmet on the head of the wearer.

70 Claims, 11 Drawing Sheets

HOCKEY HELMET COMPRISING AN OCCIPITAL ADJUSTMENT MECHANISM

FIELD OF THE INVENTION

The present invention relates to a hockey helmet having an occipital adjustment mechanism for improving the fit of the helmet on the head of the wearer.

BACKGROUND OF THE INVENTION

U.S. Pat. No. 5,898,950 entitled Protective Helmet issued to Spyrou et al. on May 4, 1999. This patent relates to a helmet comprising a protective shell and releasable attachment means having a first front strap, a second front strap, attachment members, a rear strap, a first side strap, a second side strap, a rear plate, a first support strap and a second support strap. The rear strap comprises an outer region, a first lower extension and a second lower extension, the lower extensions providing a means for cradling the head of the wearer.

U.S. Pat. No. 6,968,575 entitled Hockey Helmet comprising an Occipital Adjustment Mechanism issued to Durocher Nov. 29, 2005. This patent relates to a hockey helmet for receiving a head of a wearer, the head having a crown region and an occipital region. The helmet comprises: (a) a front shell facing the crown region of the head; (b) a rear shell facing the left and right side regions, the back region and the occipital region of the head, the rear shell comprising outer and inner surfaces and left and tight openings positioned symmetrically about a longitudinal axis of the helmet; (c) a rear inner pad facing the back and left and right side regions of the head, the rear inner pad being affixed to the inner surface of the rear shell; (d) an occipital inner pad located between the rear shell and the occipital region of the head; (e) a central member extending along the longitudinal axis of the helmet, the central member comprising an upper part that is hingely mounted to the inner surface of the rear shell and a lower part that is mounted to the occipital inner pad, the lower part comprising left and right passages positioned symmetrically about the longitudinal axis of the helmet; and (f) left and right straps passing through the respective left and right passages of the lower part and the respective left and right openings of the rear shell, each strap comprising a first end and a second end, each first end being retained in the helmet, each second end being accessible to the wearer such that, when the wearer pulls each second end of the left and right straps, the lower part of the central member is movable from a first position to a second position wherein, in the second position, the occipital inner pad applies pressure upon the occipital region of the head for urging the front shell towards the crown region of the head.

Against this background, there is a need in the industry for a helmet that provides a better fitting on the head of the wearer.

SUMMARY OF THE INVENTION

As embodied and broadly described herein, the present invention provides a hockey helmet for receiving a head of a wearer. The head has a crown region, left and right side regions, a back region and an occipital region. The helmet comprises: (a) a front shell for facing the crown region of the head; (b) a rear shell for facing the left and right side regions, the back region and the occipital region of the head, the rear shell comprising outer and inner surfaces and left and right elongated slots positioned symmetrically about a longitudinal axis of the helmet; (c) a rear inner pad for facing the back and left and right side regions of the head, the rear inner pad being affixed to the inner surface of the rear shell; (d) an occipital inner pad located between the rear shell and the occipital region of the head; (e) a central member extending along the longitudinal axis of the helmet, the central member comprising an upper part that is hingely mounted with respect to the rear shell and a lower part that is mounted to the occipital inner pad; and (f) left and right wedging members located between the occipital inner pad and the inner surface of the rear shell, each of the left and right wedging members being movable from a first position to a second position wherein, in use, in the second position, the occipital inner pad applies pressure upon the occipital region of the head for urging the front shell towards the crown region of the head.

The invention also provides a hockey helmet for receiving a head of a wearer. The head has a crown region, left and right side regions, a back region and an occipital region. The helmet comprises: (a) a front shell for facing the crown region of the head; (b) a rear shell for facing the left and right side regions, the back region and the occipital region of the head, the rear shell comprising outer and inner surfaces and left and right elongated slots positioned symmetrically about a longitudinal axis of the helmet; (c) a rear inner pad for facing the back and left and right side regions of the head, the rear inner pad being affixed to the inner surface of the rear shell; (d) an occipital inner pad located between the rear shell and the occipital region of the head; (e) a central member extending along the longitudinal axis of the helmet, the central member comprising an upper part that is hingely mounted with respect to the rear shell and a lower part that is mounted to the occipital inner pad; and (f) left and right wedging members located between the occipital inner pad and the inner surface of the rear shell, each of the left and right wedging members being movable from a first position to a second position wherein, in use, in the first position, the occipital inner pad applies a first pressure upon the occipital region of the head, and in the second position, the occipital inner pad applies a second pressure upon the occipital region of the head, the second pressure being greater than the first pressure.

The invention also provides a hockey helmet hockey helmet for receiving a head of a wearer, the head having a crown region, left and right side regions, a back region and an occipital region, The helmet comprises: (a) a front shell for facing the crown region of the head; (b) a rear shell for facing the left and right side regions, the back region and the occipital region of the head, the rear shell comprising outer and inner surfaces, left and right elongated slots positioned symmetrically about a longitudinal axis of the helmet and left and right series of notches provided along the respective left and right elongated slots; (c) a rear inner pad for facing the back and left and right side regions of the head, the rear inner pad being affixed to the inner surface of the rear shell; (d) an occipital inner pad located between the rear shell and the occipital region of the head; (e) a central member extending along the longitudinal axis of the helmet, the central member comprising all upper part that is hingely mounted with respect to the rear shell and a lower part that is mounted to the occipital inner pad; and (f) left and right wedging members located between the occipital inner pad and the inner surface of the rear shell, the left and right wedging members comprising respective left and right supports and wedgings, the left and right supports having respective left and right protrusions adapted to register with the respective left and right series of notches; (g) left and right actuators connected to the left and right supports, each left and right actuators being accessible to the wearer for moving each respective left and right wedging members from a first position to a second position wherein, in use, in the first position, the occipital inner pad applies a first pressure upon the occipital region of the head, and in the second position, the occipital inner pad applies a second pressure upon the occipital region of the head, the second pressure being greater than the first pressure.

The rear shell of the helmet has a curvature, the occipital inner pad has a rear surface that extends generally perpendicularly about the longitudinal axis of the helmet, each of the left and right wedging members has a front portion contacting the rear surface of the occipital inner pad and movement of each of the left and right wedging members away from the longitudinal axis follows the curvature of the rear shell such that the occipital inner pad moves towards the second position.

BRIEF DESCRIPTION OF THE DRAWINGS

A detailed description of the embodiments of the present invention is provided herein below, by way of example only, with reference to the accompanying drawings, in which.

Figure 1:
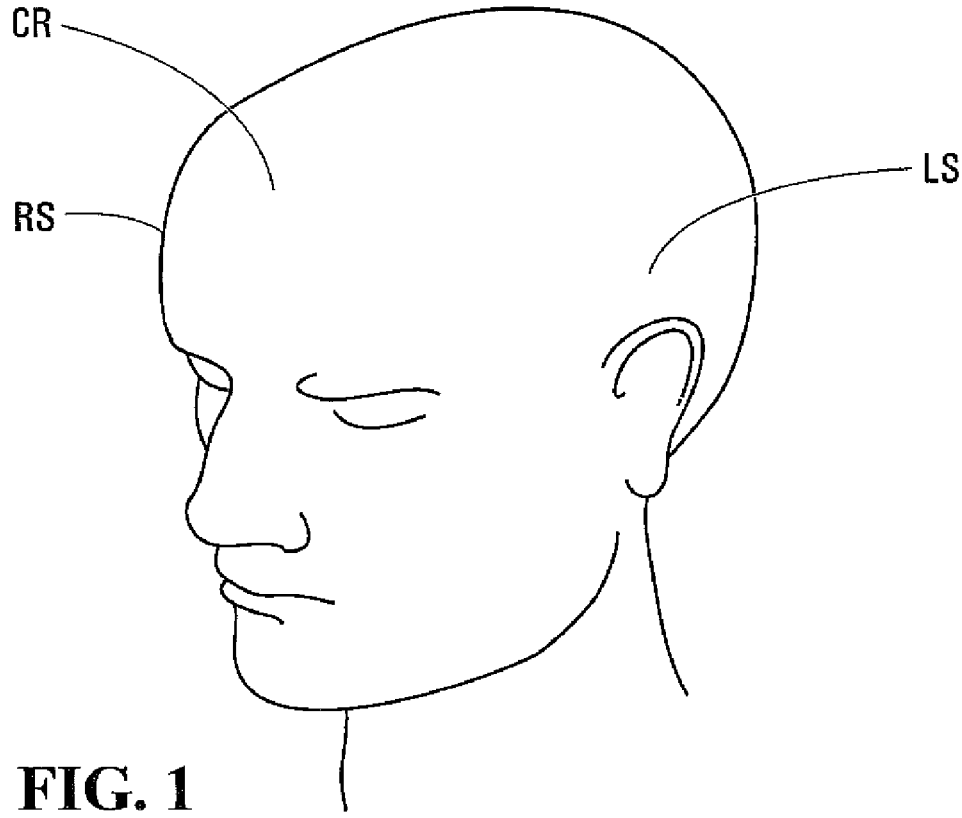
FIG. 1 is a perspective view of a head of a wearer.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS OF THE INVENTION

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Figure 2:
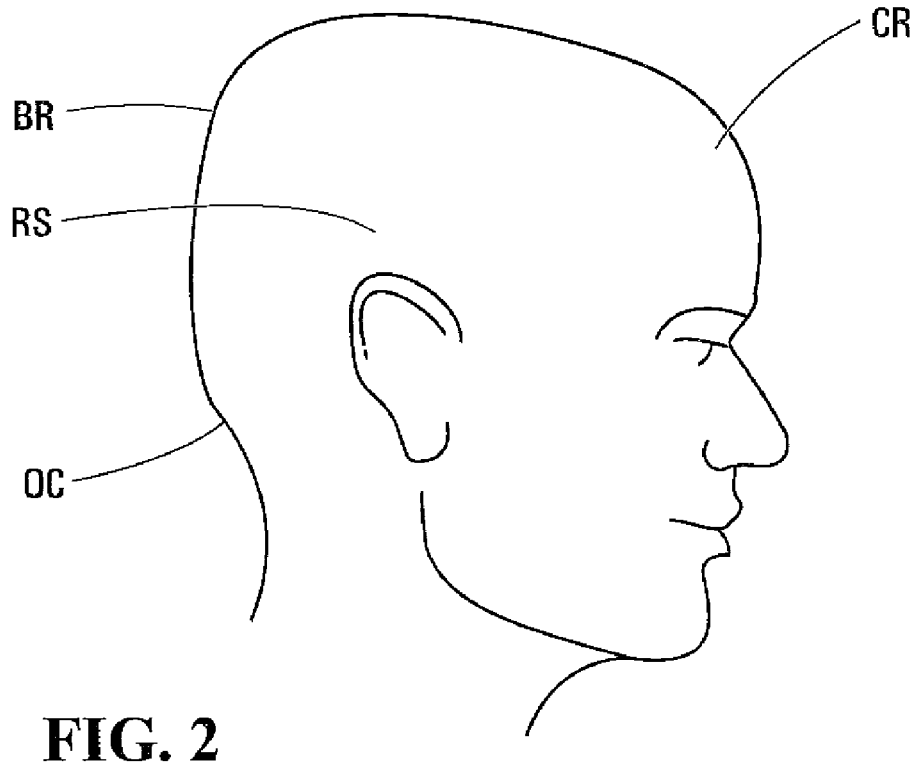
FIG. 2 is a right side elevational view of the head of the wearer of FIG. 1.
Figure 3:
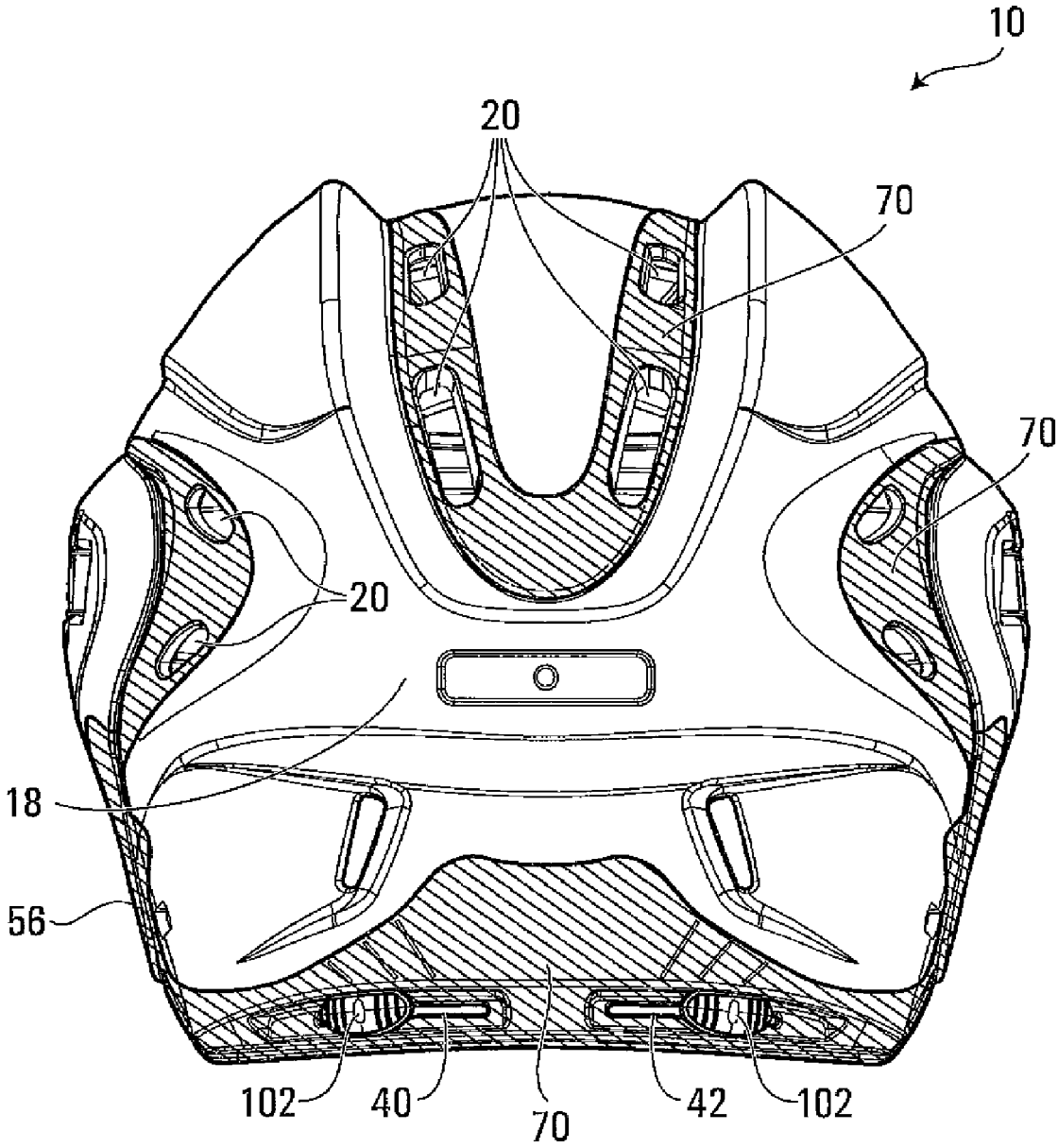
FIG. 3 is a rear elevational view of a hockey helmet constructed in accordance with an embodiment of the invention.

FIGS. 1 and 2 illustrate a head of a wearer. The bead comprises a crown region CR, left and right side regions LS, RS, a back region BR and an occipital region OC. The crown region CR has a front part that substantially corresponds to the forehead and a top part that substantially corresponds to the front top part of the head. In fact, the crown region CR generally corresponds to the frontal bone region of the head. The left and right side regions LS, RS are approximately located above the ears of the wearer. Occipital region OC substantially corresponds to the region around and under the external occipital protuberance of the head.

Referring to FIGS. 3 to 7B, the hockey helmet 10 comprises a front portion 12 and a rear portion 14 interconnected together. Front and rear portions 12, 14 comprise respective front shell 16 and rear shell 18, the rear shell comprising inner and outer surfaces 96, 98. The front shell 16 and rear shell 18 may be made of a relatively rigid material, such as polyethylene, NYLON, polycarbonate materials, thermoplastics, or thermosetting resins or any other suitable material. The front and rear shells 16, 18 includes a plurality of ventilation apertures 20 that provide the added comfort of allowing air to circulate around the head of the wearer.

The front shell 16 overlays front inner pad 22 while the rear shell overlays rear central inner pad 24, rear inner pad 30 and left and right side inner pads 26, 28. The front inner pad 22 faces the crown region CR. The central rear inner pad 24 and the rear inner pad 30 face the back region BR while the left and right side inner pads 26, 28 face the left and right side regions LS, RS. Optionally the central rear inner pad 24 and rear inner pad 30 may be integral such that they together form a single piece not made from two individual pieces. The inner pads 22, 24, 26, 28, 30 may be made of shock absorbing materials such as expanded polypropylene (EPP) or expanded polyethylene (EPE). Other materials can also be used without departing from the spirit of the invention.

The front inner pad 22 has a three-dimensional configuration that matches the three-dimensional configurations of the front shell 16 and is attached to the inner surfaces of the front shell 16 by any suitable means such glue, stitches, tacks, staples or rivets. Similarly, rear central inner pad 24, rear inner pad 30 and left and right side inner pads 26, 28 have three-dimensional configurations that match the three-dimensional configurations of the rear shells 18 and are attached to the inner surface 96 of the rear shells 18 by any suitable means, such as glue, stitches, tacks, staples or rivets.

The helmet 10 may also comprise a front comfort liner 32 affixed on the inner surface of the front inner pad 22, a top comfort liner 38 affixed on the inner surface of the rear central inner pad 24, left and right side comfort liners 34, 36 affixed on the inner surface of the respective left and right side inner pads 26, 28 and a rear comfort liner 39 affixed on the inner surface of the rear inner pad 30. The comfort liners 32, 34, 36, 38 and 39 may be made of soft materials such as polyvinyl chloride (PVC). Other materials can also be used without departing from the spirit of the invention. The comfort liners 32, 34, 36, 38 and 39 may be affixed on the inner surface of the respective inner pads 22, 26, 28 and 30 by any suitable means, such as glue, stitches, tacks, staples or rivets.

The hockey helmet 10 may comprise left and right ear loops and a chin strap adapted to be attached to ear loops so that when it is secured beneath the chin of the wearer, the helmet 10 is maintained onto the head of the wearer. If desired, the helmet 10 may be provided with left and right ear covers for protecting the ears of the wearer.

The front and rear portions 12, 14 (front and rear shells 16, 18 more particularly) can move one with relation to the other so as to adjust the size of the head receiving cavity of the helmet 10. Left and right locking mechanisms 50, 52 retain the front and rear portions 12, 14 in the position selected by the wearer. Any suitable type of locking mechanisms can be used without departing from the spirit of the invention.

In operation, a wearer who puts on the helmet 10 and realizes that it is too large or too small, does not need to remove the helmet 10 to adjust it. The wearer must simply release the locking mechanism 50, 52 expand or contract the size of the helmet 10 by displacing the front and the rear portion 12, 14 in relation to each other in the appropriate direction.

Alternatively, helmet 10 may comprise a non-adjustable one-piece shell covering a one-piece inner pad and a one-piece comfort liner. In another possible variant, the helmet 10 may comprise separate front and rear portions 12, 14 that are connected to one another in any suitable way but not adjustable one relative to the other.

The rear shell 18 comprises left and right elongated slots 40, 42, positioned symmetrically about a longitudinal axis of the helmet 10. In the example provided, left and right elongated slots 40, 42 extend perpendicularly to the longitudinal axis of the helmet 10 along the base of the rear shell 18. As shown on FIGS. 5B, 7A, 10A and 10B, the rear shell 18 may have left and right series of notches 48 extending along the respective elongated slots 40, 42. The series may be disposed, for example, above and below each slot.

FIGS. 3 to 10B show an occipital adjustment mechanism comprising an occipital inner pad 54 located between the rear shell 18 and the occipital region of the head OC, a central member 62 extending along the longitudinal axis of the helmet, the central member 62 comprising an upper part 64 that is hingely mounted with respect to the rear shell 18 and a lower part 66 that is mounted to the occipital inner pad 54; and left and right wedging members 44, 46 located between the occipital inner pad 54 and the inner surface 96 of the rear shell 18. Each of the left and right wedging members 44, 46 has a support 108 and a wedging 10 having a front portion that contacts the occipital inner pad 54. The left and right supports 108 contact the inner surface 96 of the rear shell 18, each of the left and right supports 108 having protrusions 118 adapted to register with the series of notches 48; left and right actuators 102 being connected to the left and right supports 108, each left and right actuators 102 being accessible to the wearer for moving each respective left and right wedging members 44, 46 from a first position to a second position wherein, in use, in the first position, the occipital inner pad applies a first pressure upon the occipital region of the head (see FIGS. 5A and 6A), and in the second position, the occipital inner pad applies a second pressure upon the occipital region of the head (see FIGS. 5B and 6B), the second pressure being greater than the first pressure. Although the support 108 and the wedging 110 are shown here as two connected pieces, it is to be understood that they could also be integral, such that they are formed as a single piece and not from two pieces.

Figure 5A:
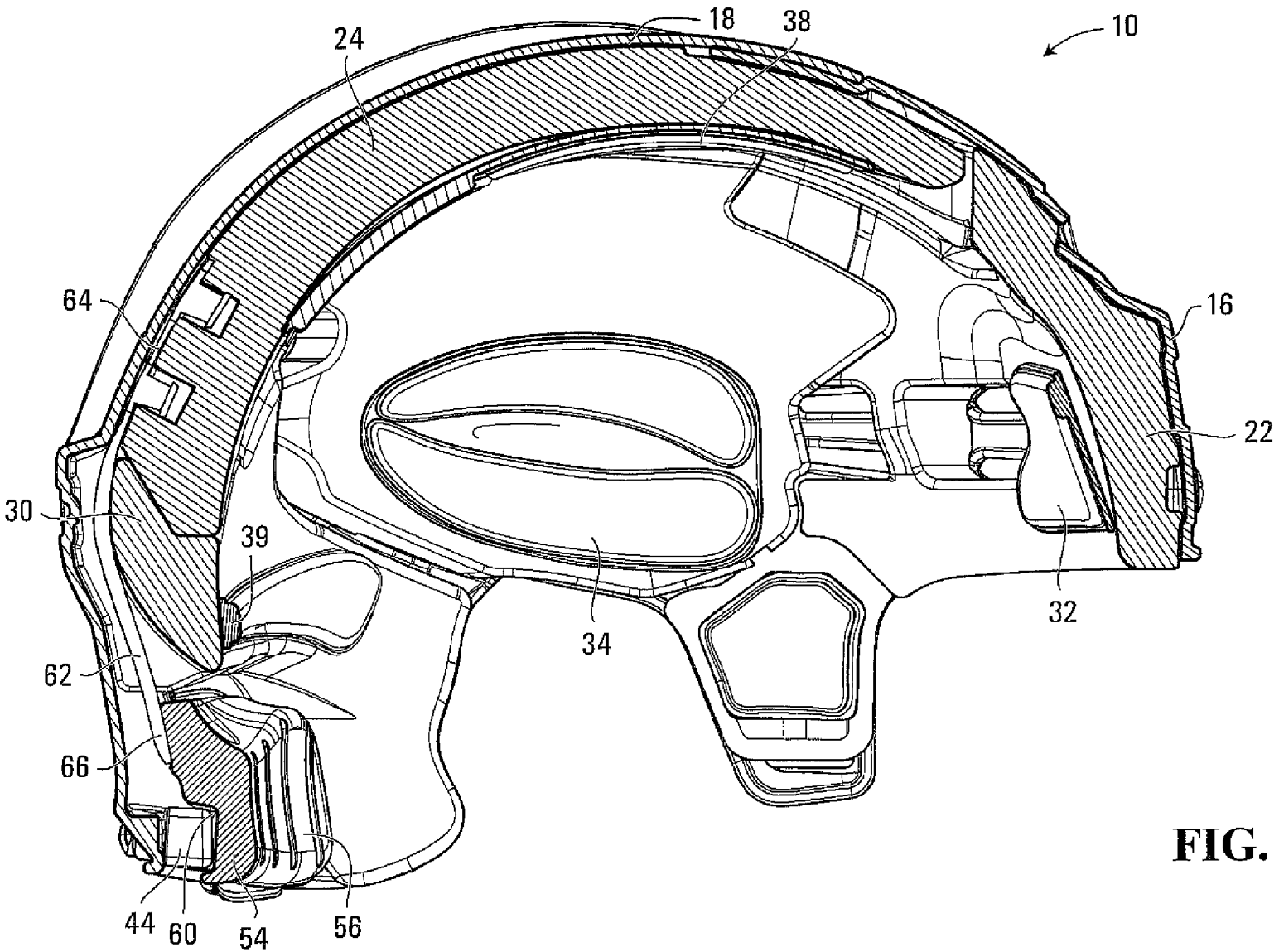
FIG. 5A is a side cross-sectional view of the hockey helmet of FIG. 4 taken along line 5A-5A with the occipital inner pad shown in a first position.
Figure 5B:
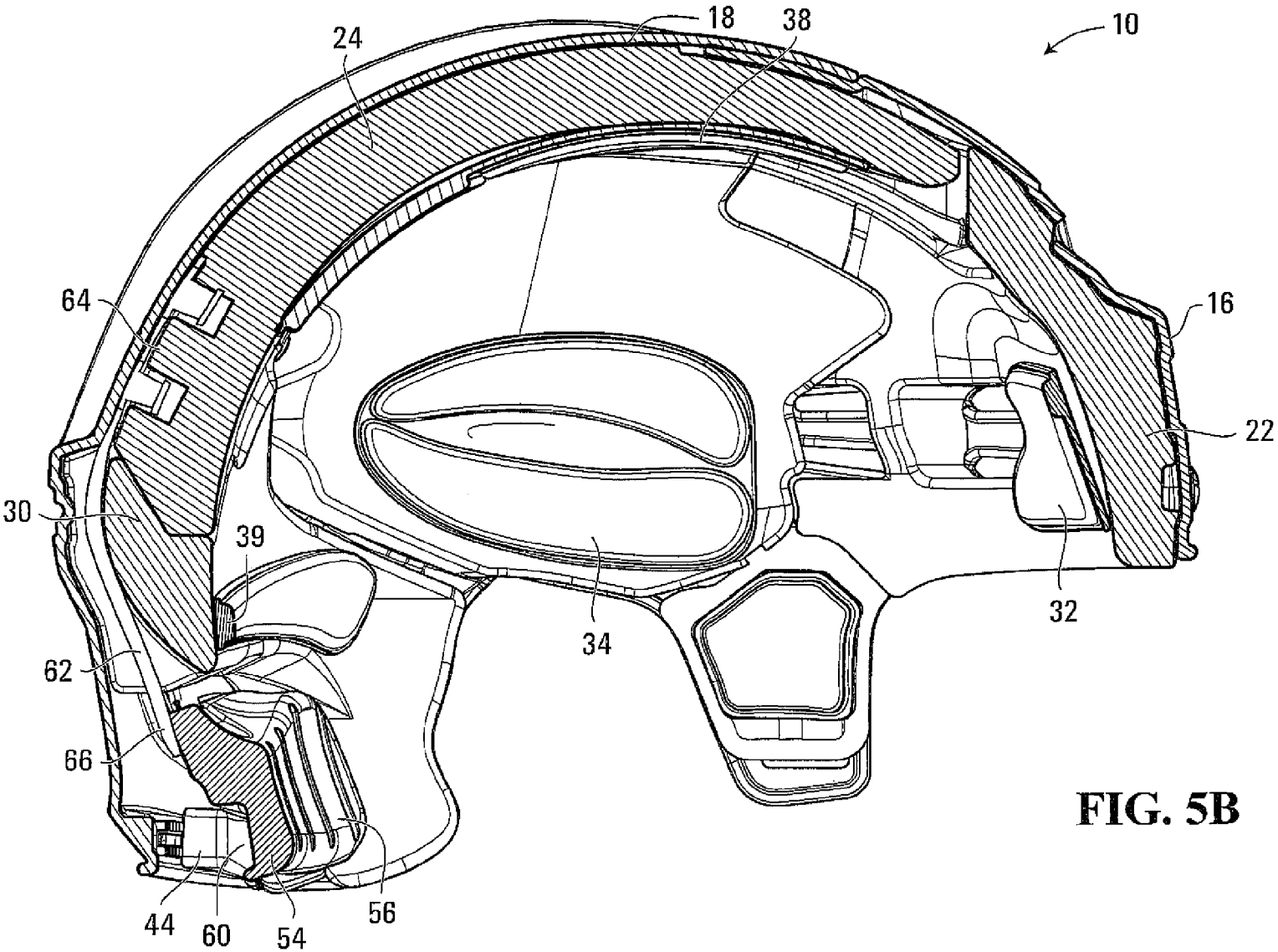
FIG. 5B a side cross-sectional view of the hockey helmet of FIG. 4 taken along line 5A-5A with the occipital inner pad shown in a second position.
Figure 6A:
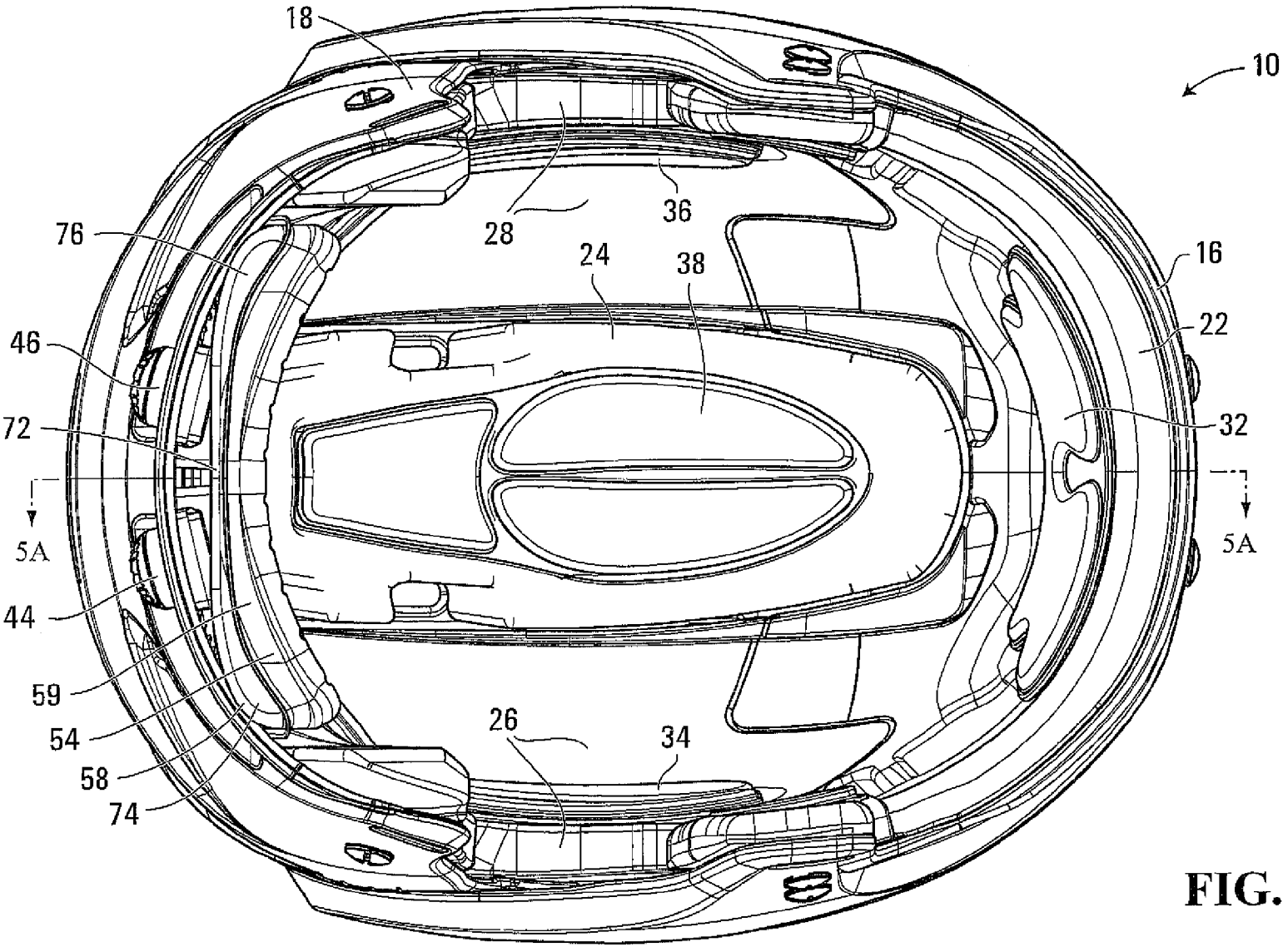
FIG. 6A is a bottom view of the hockey helmet of FIG. 4 with the occipital inner pad shown in a first position.
Figure 6B:
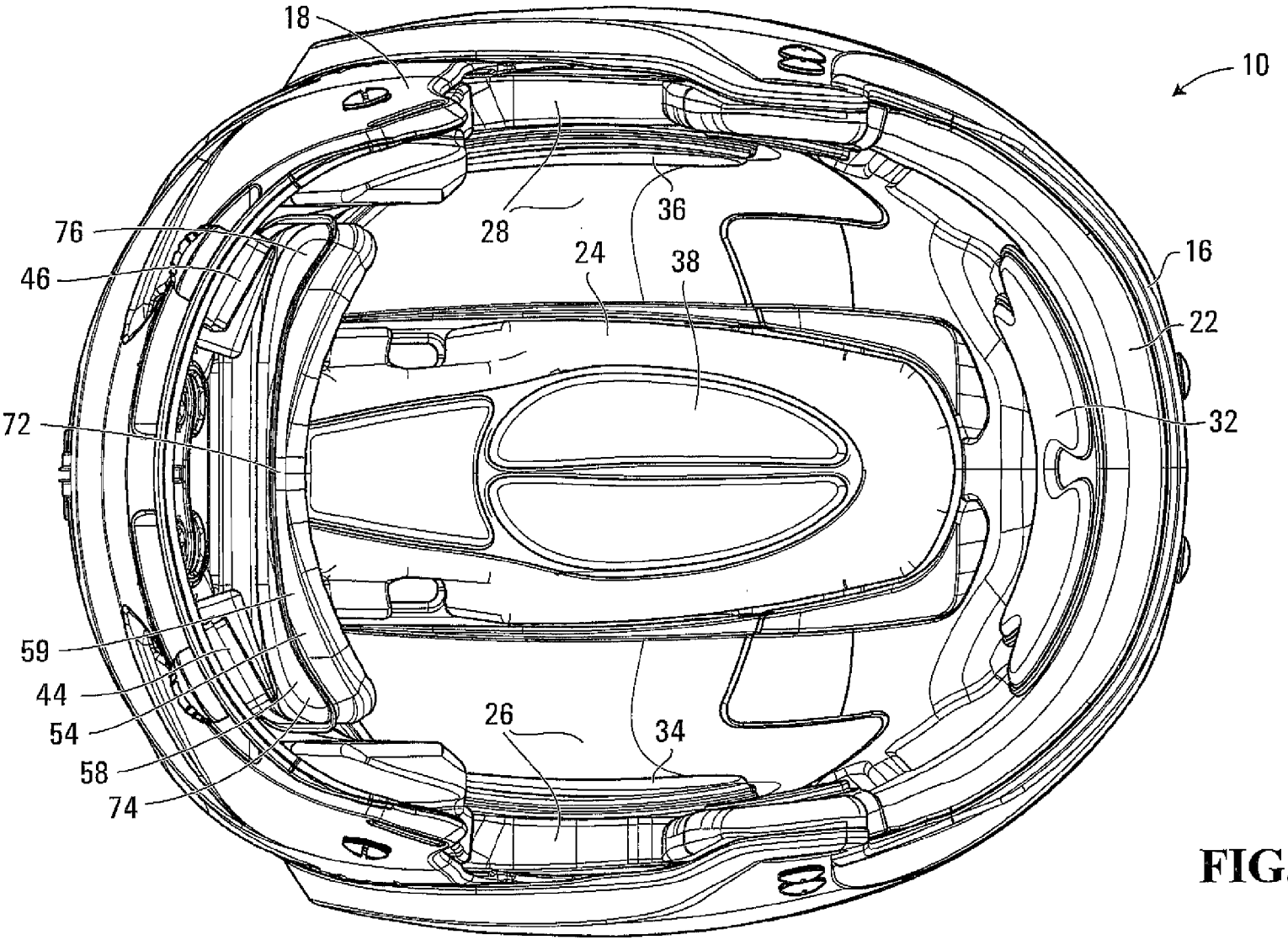
FIG. 6B is a bottom view of the hockey helmet of FIG. 4 with the occipital inner pad shown in a second position.
Figure 7A:
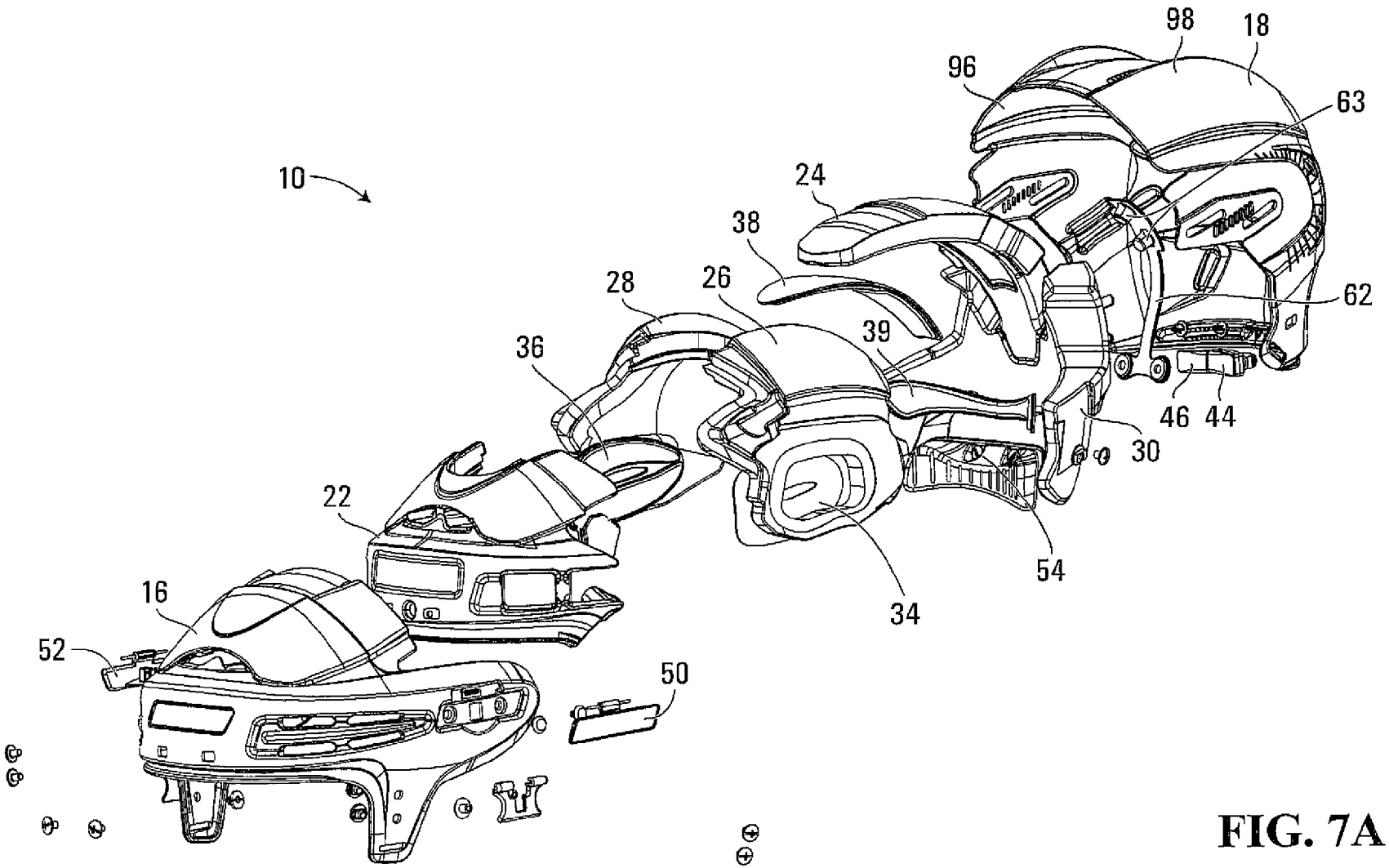
FIG. 7A is a front perspective exploded view of the hockey helmet of FIG. 4.
Figure 7B:
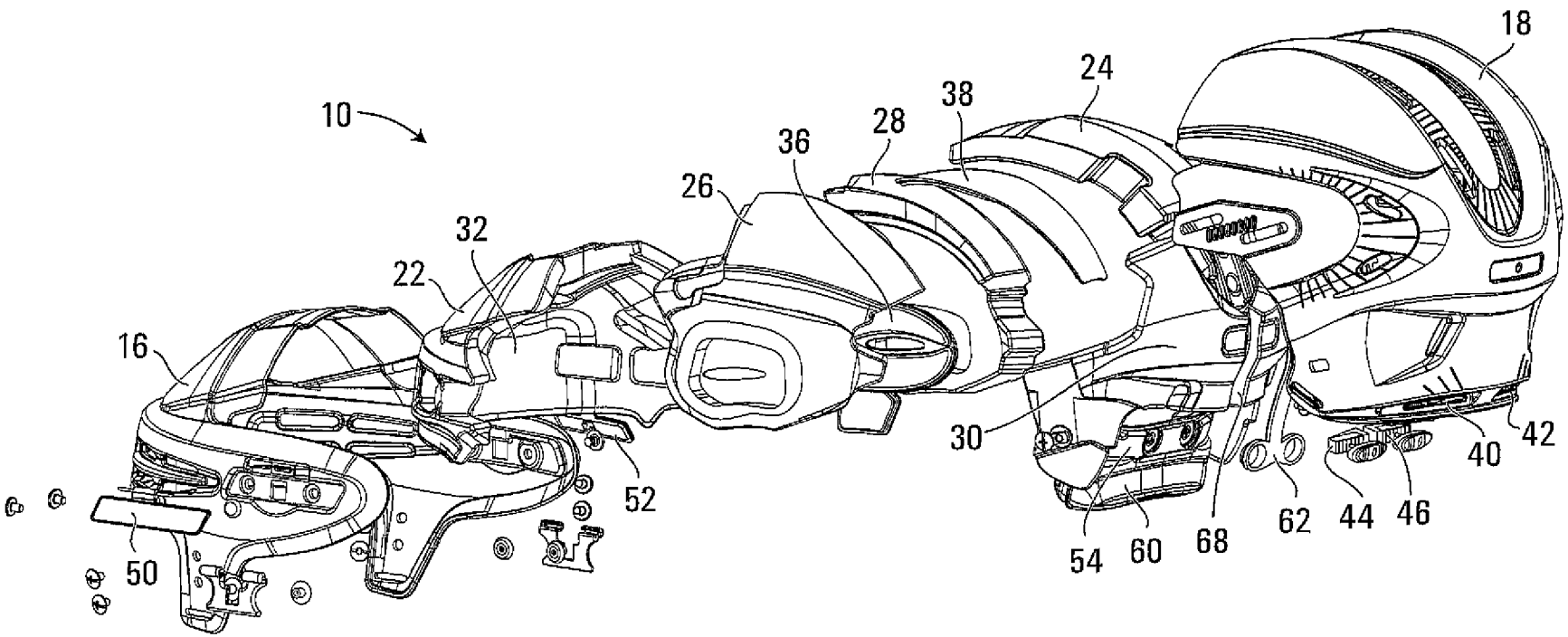
FIG. 7B is a rear perspective exploded view of the hockey helmet of FIG. 4.
Figure 8:
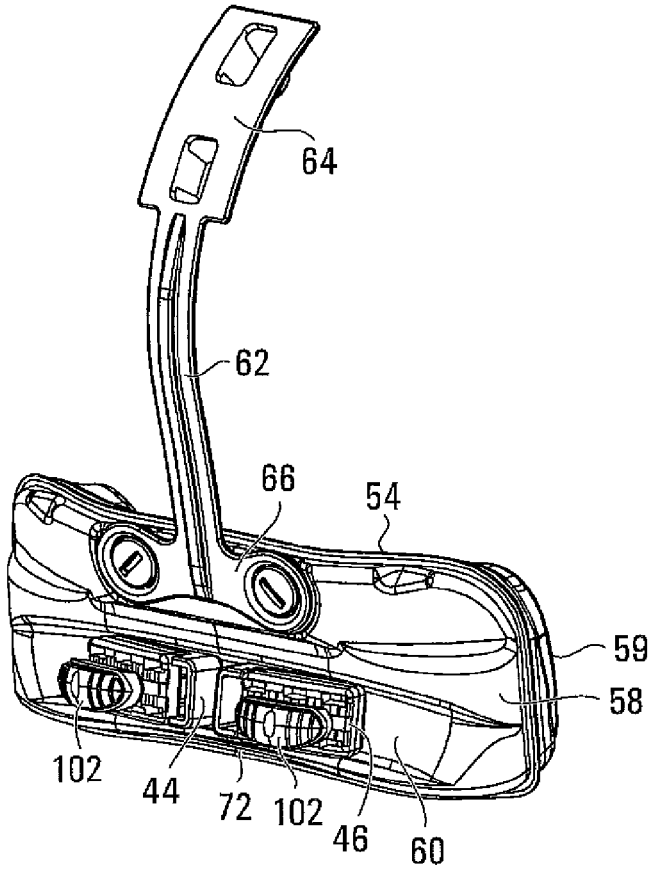
FIG. 8 is a perspective view of the occipital adjustment mechanism for the hockey helmet of FIG. 4.
Figure 9:
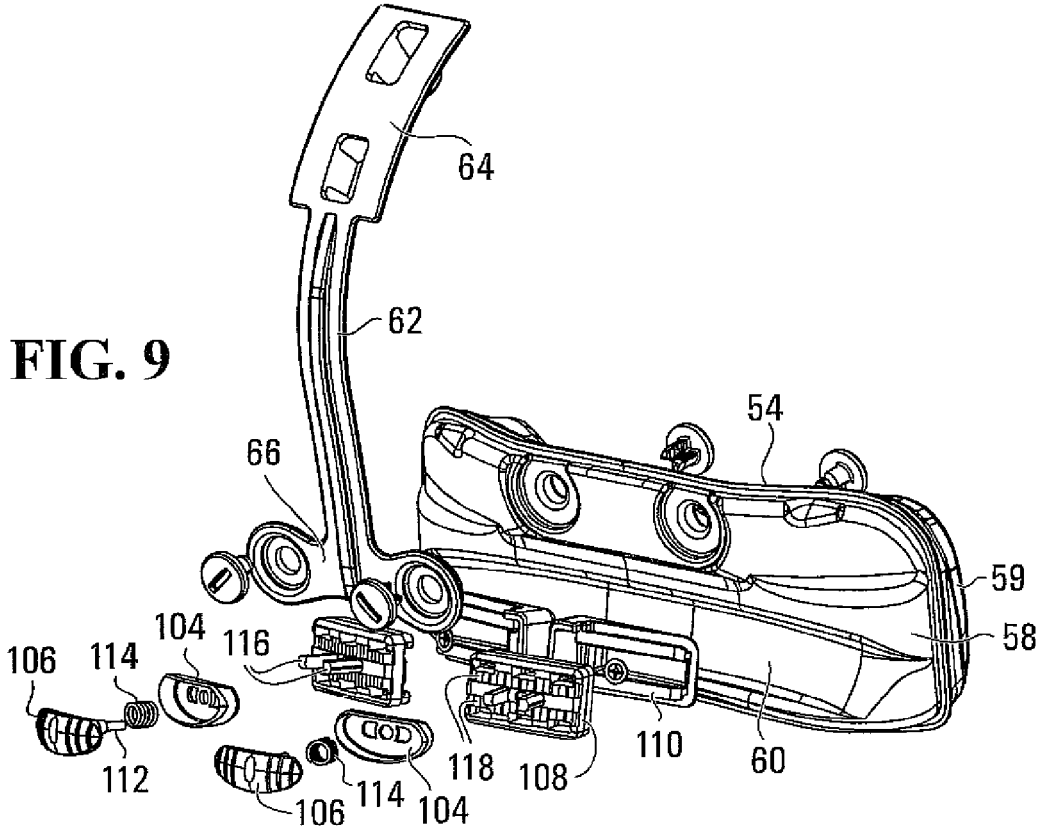
FIG. 9 is a perspective exploded view of the occipital adjustment mechanism of FIG. 8.

The occipital inner pad 54 faces the occipital region OC of the head, the occipital inner pad 54 being movable between the first position shown in FIGS. 5A and 6A to the second position shown in FIGS. 5B and 6B. In the second position the occipital inner pad 54 applies pressure upon the occipital region OC for urging the front portion 12 (front shell 16, front inner pad 22 and front and top comfort liners 32, 38) towards the crown region CR (as previously indicated, the crown region CR has a front part that substantially corresponds to the forehead and a top part that substantially corresponds to the front top part of the head). Depending on how tightly the head of the wearer fits in the head receiving cavity of the helmet 10, the pressure applied by the occipital inner pad 54 induces a corresponding movement of the helmet 10 towards the back of the head, necessary to seat the front portion 12 of the helmet 10 against the crown region CR of the head. Also, depending on how tightly the head of the wearer fits in the head receiving cavity of the helmet, in the first position the occipital inner pad 54 may apply a first pressure upon the occipital region OC of the head, and in the second position the occipital inner pad 54 applies a second pressure upon the occipital region OC of the head, the second pressure being greater than the first pressure.

The occipital inner pad 54 may be made of expanded polypropylene (EPP) or expanded polyethylene (EPE) or polyethylene foam or polyethylene foam having two different densities. Other materials can also be used without departing from the spirit of the invention. The occipital inner pad 54 may comprise a rear portion 58 facing the inner surface 96 of the rear shell 18 and a front portion 59 for facing the occipital region of the head. The front portion 59 has an inner surface 56 and may be less rigid than the rear portion 58. The inner surface 56 may have a ribbed pattern and may be made of a soft absorbent material while the rear portion 58 may be made of a rigid plastic-like material or equivalent. Optionally, one or more comfort liners may be affixed to the inner surface 56, by any suitable means.

As shown, the central member 62 is an elongated piece extending along the longitudinal axis of the helmet from an upper part 64, that is hingely mounted with respect to the rear shell 18 (e.g. to the rear central inner pad 24 as best shown in FIG. 5B); or to the inner surface 96 of the rear shell 18 (now shown)), to a lower part 66 that is mounted to the occipital inner pad 54. The central member 62 can be hingely mounted to the rear shell 18, rear central inner pad 24, or rear inner pad 30, and attached to the occipital inner pad 54 by any suitable means. In a non-limiting example, the lower part 66 is screwed to the occipital inner pad 54. Other affixing means (e.g. glue, stitches, rivets, tacks, staples) can be used without departing from the intended scope of the invention and in a another non-limiting example, the central member 62 may be attached to the occipital inner pad 54 by virtue of being integral, and therefore continuous, with the occipital inner pad 54. The central member 62 may be located between the rear shell 18 and the rear inner pad 30. As shown on FIGS. 7A and 7B, the rear inner pad 30 may include a groove 68 to accommodate the central member 62 and the rear central inner pad 24 may include apertures 33 to receive pegs 63 provided on the upper part 64 such that the upper part 64 is hingely mounted to the rear central inner pad 24. Hinging may be provided in central member 62 by any suitable means, and in the example shown, it is provided by the bendability of central member 62.

As shown on FIGS. 5A and 6B, left and right wedging member 44, 46 are located between the occipital inner pad 54 and the inner surface 96 of the rear shell 18. Each of left and right wedging members 44, 46 are independently movable from a first position to a second position such that, in use, the occipital inner pad 54 applies a different pressure upon the occipital region of the head when the left and light wedging member 44, 46 are moved from the first position to the second position where pressure applied by the occipital inner pad urges the front shell towards the crown region of the head.

Figure 10B:
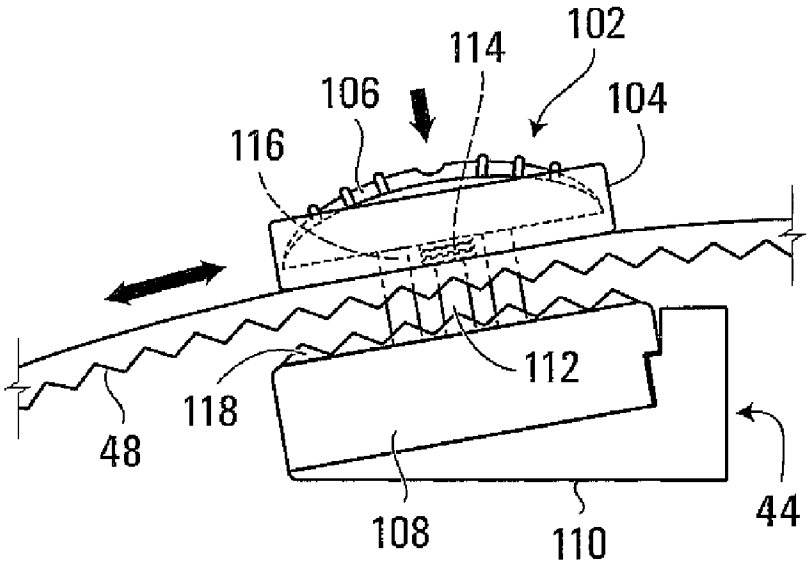
FIG. 10B is an enlarged view of the wedging member of the occipital adjustment mechanism of FIG. 8, shown in an unlock position.
Figure 10A:
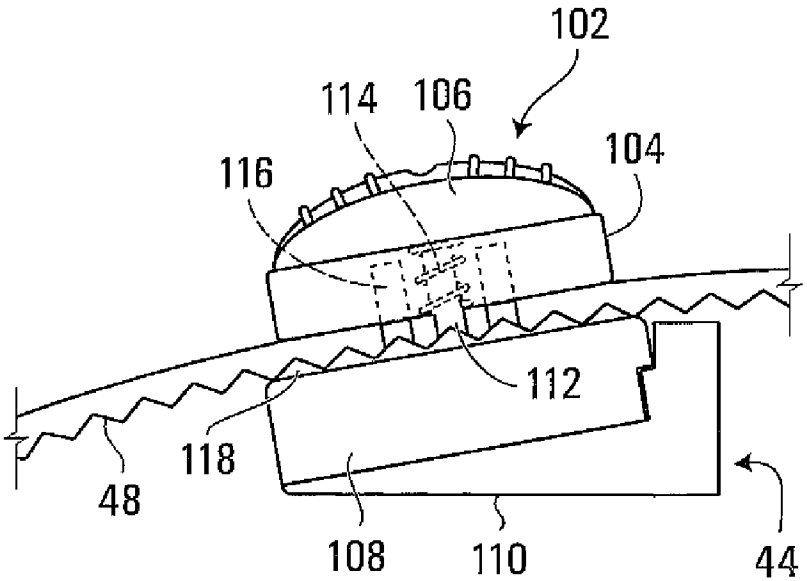
FIG. 10A is an enlarged view of the wedging member of the occipital adjustment mechanism of FIG. 8, shown in a lock position.

Left and right wedging members 44, 46 may comprise a locking mechanism which can be any suitable mechanism for preventing unintentional movement of the left and right wedging member 44, 46. In the example provided, the locking mechanism comprises a series of protrusions 118 provided on the support 108 adapted to engage the matching series of notches 48 provided on the inner surface 96 of the rear shell 18. FIG. 10A shows the support 108 in a lock position. Here the locking mechanism is engaged and the protrusions 118 of the support 108 register with the notches 46. When the support 108 is in the unlock position, as shown in FIG. 10B, the support 108 is pushed away from the inner surface 96 of the rear shell 18 and the protrusions 118 no longer register with the notches 46 such that movement of each wedging member is possible. The notches 118 and protrusions 48 are shown here as being generally triangular in cross-section; however any other form, in any other suitable orientation, may be used. Furthermore, any other frictional engagement is contemplated for the locking mechanism. For example, a rubber friction surface could also be used.

The helmet 10 also comprises respective actuators 102 that are connected to the respective wedging members 44, 46 and are accessible to the wearer for moving the left and right wedging members 44, 46. Each actuator 102 comprises a post 112 extending from a button 106 through the elongated slot 40; 42 to the support 108 of the wedging member 44; 46. A biasing element 114 is provided that pushes the button 106 away from the outer surface 98 of rear shell 18. As a result, the post 112 pulls the support 108 towards the inner surface 96 of rear shell 18 and holds the support 108 in the lock position. When the button 106 is pushed towards the rear shell 18, the biasing element 114 is compressed and the support 108 is pushed away from the inner surface 96 of the rear shell 18, thus disengaging the protrusions 118 from the notches 46 and allowing the wedging member 44; 46 to be moved along the elongated slots 40; 42. In the example provided, the biasing element 114 is a spring mounted on the post 112, however any other suitable biasing means could be used.

In the example provided, the actuator 102 has a receptacle 104 for encircling the button 106. The post 112 passes through a hole in the base of the receptacle 104 and two guide bars 116 protrude from the support 108 through the elongated slot 40; 42 and through one or more holes in the base of receptacle 104. The guide bars 116 serve to prevent the rotation of the receptacle 104 about the axis of post 112. The guide bars do not extend so far as to impede the depression of actuator 102. Advantageously, the button 106 is always at least partially contained within the receptacle 104 and thus is also kept from rotating about the axis of the post 112 by the receptacle 104 that is anchored by the guide bars 116. Furthermore, the biasing element 112 is between the button 106 and the base of the receptacle 104 and thus does not touch the outer surface 98 of the rear shell 18. Instead the receptacle 104 acts as a skid plate of the actuator 102 and biasing element 112. It should be noted that although two guide bars 116 are shown here, more than two or only one guide bar 116 could also be used. Furthermore, neither guide bars 116 nor receptacle 104 are necessary, but merely useful in preventing rotation of the button 106 about the axis of post 112.

As shown in FIGS. 6A and 6B, the rear shell 18 follows a curvature while the rear surface of the occipital inner pad 54 extends generally perpendicularly with respect to the longitudinal axis of the helmet 10. Each of the left and right wedging members 44, 46 (the wedging 110 more precisely) has a front portion contacting the rear surface of the occipital inner pad 54. Because this front portion always remains in contact with the rear surface of the occipital inner pad 54, movement of each of the left and right wedging members 44, 46 away from the longitudinal axis of the helmet 10 and along the curvature of the rear shell imparts a movement of the occipital inner pad 54 towards the second position shown in FIG. 6B.

As seen in FIGS. 5A and 6A, when the left and right wedging members 44, 46 are in the central most position, that is in the position closest to the central longitudinal axis of the helmet 10, the occipital inner pad 54 is in a first position. As the left and right wedging members 44, 46 are moved outwards away from the central longitudinal axis of helmet 10, the left and right wedging members 44, 46 follow the curvature of the rear shell 18 and as such, impart a movement of the occipital inner pad 54, which moves forward towards the second position shown in FIGS. 5B and 6B.

As mentioned above, the occipital inner pad 54 may comprise a base portion 58 and a pad portion 59. The base portion 58 is rigid so that movement of the left and right wedging members 44, 46 outwards does not easily deform occipital inner pad 54 but rather pushes it forwards towards the occipital region OC. The base portion 58 may have a channel 160 dimensioned to accommodate the wedging members 44, 46. The pad portion 59 is made of padding material for comfort and protection of the occipital region.

Figure 4:
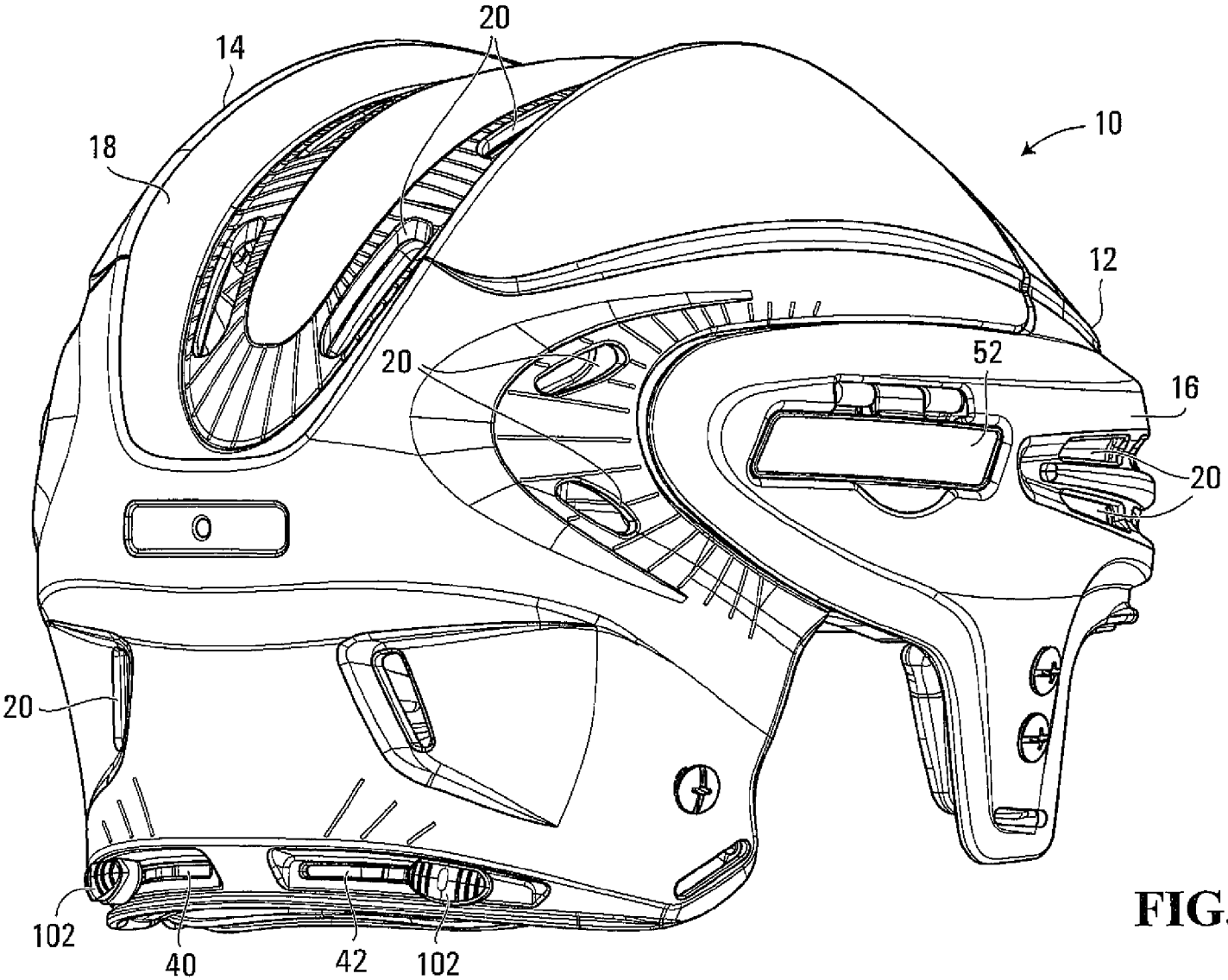
FIG. 4 is a rear perspective view of a hockey helmet constructed in accordance with an embodiment of the invention.

FIG. 4 shows a non-limiting embodiment wherein the rear shell 18 of helmet 10 comprises certain optional overmolded portions 70 made with a different material than the rest of the rear shell 18. The overmolded portion 70 may have a greater flexibility than the rest of the rear shell 18. The overmolded portion 70 may be made with a material having a lower tensile strength than the rest of the rear shell 18 and in a non-limiting example, it may be made with medium density polypropylene. Overmolded portion 70 may extend from the inner surface 96 to the outer surface 98 of the rear shell 18 or alternatively may extend only through part of the thickness of rear shell 18. In the example shown in FIG. 4, there is an overmolded portion 70 behind the occipital inner pad 54 along the base of the rear shell 18 and elongated slots 40, 42 are defined within overmolded portion 70. However, overmolded portion 70 may be located elsewhere on the rear shell 18 or may be completely absent and the elongated slots 40, 42 need not be defined in an overmolded portion 70.

The present invention provides the user of helmet 10 with an easy and convenient way to adjust the occipital inner pad 54. The left and right wedging members 44, 46 are moveable via actuators 102 to adjust the position of occipital inner pad 54 while the helmet 10 is being worn. A locking mechanism which may be provided on respective supports 108 of the left and right wedging members 44, 46 prevent the unintentional displacement of the left and right wedging members 44, 46.

The above description of the embodiments should not be interpreted in a limiting manner since other variations, modifications and refinements are possible within the spirit and scope of the present invention. The scope of the invention is defined in the appended claims and their equivalents.

The invention claimed is:

1. A hockey helmet for receiving a head of a wearer, the head having a crown region, left and right side regions, a back region and an occipital region, said helmet comprising:

(a) a front shell for facing the crown region of the head;

(b) a rear shell for facing the left and right side regions, the back region and the occipital region of the head, said rear shell comprising outer and inner surfaces and left and right elongated slots positioned symmetrically about a longitudinal axis of the helmet;

(c) a rear inner pad for facing the back and left and right side regions of the head, said rear inner pad being affixed to said inner surface of said rear shell;

(d) an occipital inner pad located between said rear shell and the occipital region of the head;

(e) a central member extending along the longitudinal axis of said helmet, said central member comprising an upper part that is hingedly mounted with respect to said rear shell and a lower part that is mounted to said occipital inner pad; and (f) left and right wedge members located between said occipital inner pad and said inner surface of said rear shell, each of said left and right wedge members being movable from a first position to a second position wherein, in use, in said second position, said occipital inner pad applies pressure upon the occipital region of the head for urging said front shell towards the crown region of the head.

2. A hockey helmet as defined in claim 1, wherein said left and right wedge members are independently movable between said first and second positions to allow independent adjustment.

3. A hockey helmet as defined in claim 2, further comprising left and right actuators connected to said respective left and right wedge members, said left and right actuators being accessible to the wearer for moving said left and right wedge members between said first and second positions.

4. A hockey helmet as defined in claim 3, wherein said left and right actuators comprise respective left and right post extending through said left and right elongated slots respectively.

5. A hockey helmet as defined in claim 4, wherein said left and right actuators comprise respective left and right biasing elements and left and right buttons that are accessible to the wearer such that the wearer can operate said left and right actuators.

6. A hockey helmet as defined in claim 5, wherein said left and right actuators comprise respective left and right receptacles for receiving respectively said left and right buttons, wherein said left and right posts extend through said left and right receptacles respectively.

7. A hockey helmet as defined in claim 6, wherein said left and right wedge members each comprise at least one guide bar extending through said left and right elongated slots and said left and right receptacles respectively.

8. A hockey helmet as defined in claim 5, wherein each of said left and right wedge members comprises a locking mechanism, said locking mechanism preventing said respective wedge member from moving unintentionally.

9. A hockey helmet as defined in claim 8, wherein said locking mechanism comprises protrusions adapted to register with a series of notches provided on said inner surface of said rear shell.

10. A hockey helmet as defined in claim 5, wherein said left and right wedge members comprise respective left and right supports and left and right wedgings, said left and right supports being adapted for contacting said inner surface of said rear shell and said left and right wedgings being adapted to contact said occipital inner pad.

11. A hockey helmet as defined in claim 10, wherein said left and right supports are integral with left and right wedgings.

12. A hockey helmet as defined in claim 10, wherein said left and right support each comprise protrusions adapted to register with a series of notches provided on said inner surface of said rear shell for preventing movement of said respective wedge member.

13. A hockey helmet as defined in claim 9, wherein upon pressing of one of left and right buttons by the wearer, the corresponding biasing element is compressed and allows disengaging of said protrusions from said notches such that movement of corresponding wedge member is possible.

14. A hockey helmet as defined in claim 1, wherein said rear shell has a curvature, wherein said occipital inner pad has a rear surface that extends generally perpendicularly about the longitudinal axis of said helmet, wherein each of said left and right wedge members has a front portion contacting said rear surface of said occipital inner pad and wherein movement of each of said left and right wedge members away from said longitudinal axis follows the curvature of said rear shell such that said occipital inner pad moves towards said second position.

15. A hockey helmet as defined in claim 1, wherein said occipital inner pad comprises a rear portion facing said inner surface of said rear shell and a front portion, wherein said rear portion has a greater rigidity than said front portion.

16. A hockey helmet as defined in claim 1, wherein said central member is integral with said occipital inner pad.

17. A hockey helmet as defined in claim 1, wherein said rear shell comprises an overmolded portion being made of a different material than the rest of said rear shell, and wherein said left and right elongated slots are provided in said overmolded portion.

18. A hockey helmet as defined in claim 1, wherein said occipital inner pad is made of expanded polypropylene (EPP) or expanded polyethylene (EPE) or polyethylene foam.

19. A hockey helmet as defined in claim 18, wherein said occipital inner pad further comprises an occipital comfort liner affixed to an inner surface of said occipital inner pad.

20. A hockey helmet as defined in claim 19, wherein said occipital comfort liner is made of polyvinyl chloride (PVC).

21. A hockey helmet as defined in claim 20, further comprising a front inner pad and a top inner pad affixed on said inner surface of said front shell.

22. A hockey helmet as defined in claim 21, further comprising a rear central inner pad and left and right side inner pads affixed on said inner surface of said rear shell.

23. A hockey helmet as defined in claim 22, further comprising a front comfort liner affixed on an inner surface of said front inner pad and a top comfort liner affixed on an inner surface of said top inner pad.

24. A hockey helmet as defined in claim 23, further comprising left and right side comfort liners affixed on an inner surface of respective said left and right inner pads.

25. A hockey helmet as defined in claim 24, wherein said front shell is movable relative to said rear shell for allowing size adjustment of said helmet.

26. A hockey helmet hockey helmet for receiving a head of a wearer, the head having a crown region, left and right side regions, a back region and an occipital region, said helmet comprising:

(a) a front shell for facing the crown region of the head;

(b) a rear shell for facing the left and right side regions, the back region and the occipital region of the head, said rear shell comprising outer and inner surfaces and left and right elongated slots positioned symmetrically about a longitudinal axis of the helmet;

(c) a rear inner pad for facing the back and left and right side regions of the head, said rear inner pad being affixed to said inner surface of said rear shell;

(d) an occipital inner pad located between said rear shell and the occipital region of the head;

(e) a central member extending along the longitudinal axis of said helmet, said central member comprising an upper part that is hingedly mounted with respect to said rear shell and a lower part that is mounted to said occipital inner pad; and (f) left and right wedge members located between said occipital inner pad and said inner surface of said rear shell, each of said left and right wedge members being movable from a first position to a second position wherein, in use, in said first position, said occipital inner pad applies a first pressure upon the occipital region of the head, and in said second position, said occipital inner pad applies a second pressure upon the occipital region of the head, the second pressure being greater than the first pressure.

27. A hockey helmet as defined in claim 26, wherein said left and right wedge members are independently movable between said first and second positions to allow independent adjustment.

28. A hockey helmet as defined in claim 27, further comprising left and right actuators connected to said respective left and right wedge members, said left and right actuators being accessible to the wearer for moving said left and right wedge members between said first and second positions.

29. A hockey helmet as defined in claim 28, wherein said left and right actuators comprise respective left and right posts extending through said left and right elongated slots respectively.

30. A hockey helmet as defined in claim 29, wherein said left and right actuators comprise respective left and right biasing element and respective left and right buttons that are accessible to the wearer such that the wearer can operate said left and right actuators.

31. A hockey helmet as defined in claim 30, wherein said left and right actuators comprise respective left and right receptacles for receiving respectively said left and right buttons, wherein said left and right posts extend through said left and right receptacles respectively.

32. A hockey helmet as defined in claim 31, wherein said left and right wedge members each comprise at least one guide bar extending through said left and right elongated slots and said left and right receptacles respectively.

33. A hockey helmet as defined in claim 30, wherein each of said left and right wedge members comprises a locking mechanism, said locking mechanism preventing said respective wedge member from moving unintentionally.

34. A hockey helmet as defined in claim 33, wherein said locking mechanism comprises protrusions adapted to register with a series of notches provided on said inner surface of said rear shell.

35. A hockey helmet as defined in claim 30, wherein said left and right wedge members comprise respective left and right supports and left and right wedgings, said left and right supports being adapted for contacting said inner surface of said rear shell and said left and right wedgings being adapted to contact said occipital inner pad.

36. A hockey helmet as defined in claim 35, wherein said left and right supports are integral with left and right wedgins.

37. A hockey helmet as defined in claim 35, wherein said left and right supports each comprise protrusions adapted to register with a series of notches provided on said inner surface of said rear shell for preventing movement of said respective wedge member.

38. A hockey helmet as defined in claim 34, wherein upon pressing of one of left and right buttons by the wearer, the corresponding biasing element is compressed and allows disengaging of said protrusions from said notches such that movement of corresponding wedge member is possible.

39. A hockey helmet as defined in claim 26, wherein said rear shell has a curvature, wherein said occipital inner pad has a rear surface that extends generally perpendicularly about the longitudinal axis of said helmet, wherein each of said left and right wedge members has a front portion contacting said rear surface of said occipital inner pad and wherein movement of each of said left and right wedge members away from said longitudinal axis follows the curvature of said rear shell such that said occipital inner pad moves towards said second position.

40. A hockey helmet as defined in claim 26, wherein said occipital inner pad comprises a rear portion facing said inner surface of said rear shell and a front portion for facing said occipital region of the head, wherein said rear portion has a greater rigidity than said front portion.

41. A hockey helmet as defined in claim 26, wherein said central member is integral with said occipital inner pad.

42. A hockey helmet as defined in claim 26, wherein said rear shell comprises an overmolded portion being made of a different material than the rest of said rear shell, and wherein said left and right elongated slots are provided in said overmolded portion.

43. A hockey helmet as defined in claim 26, wherein said occipital inner pad is made of expanded polypropylene (EPP) or expanded polyethylene (EPE) or polyethylene foam.

44. A hockey helmet as defined in claim 43, wherein said occipital inner pad further comprises an occipital comfort liner affixed to an inner surface of said occipital inner pad.

45. A hockey helmet as defined in claim 44, wherein said occipital comfort liner is made of polyvinyl chloride (PVC).

46. A hockey helmet as defined in claim 45, further comprising a front inner pad and a top inner pad affixed on said inner surface of said front shell.

47. A hockey helmet as defined in claim 46, further comprising a rear central inner pad and left and right side inner pads affixed on said inner surface of said rear shell.

48. A hockey helmet as defined in claim 47, further comprising a front comfort liner affixed on an inner surface of said front inner pad and a top comfort liner affixed on an inner surface of said top inner pad.

49. A hockey helmet as defined in claim 48, further comprising left and right side comfort liners affixed on an inner surface of respective said left and right inner pads.

50. A hockey helmet as defined in claim 49, wherein said front shell is movable relative to said rear shell for allowing size adjustment of said helmet.

51. A hockey helmet for receiving a head of a wearer, the head having a crown region, left and right side regions, a back region and an occipital region, said helmet comprising:

(a) a front shell for facing the crown region of the head;

(b) a rear shell for facing the left and right side regions, the back region and the occipital region of the head, said rear shell comprising outer and inner surfaces, left and right elongated slots positioned symmetrically about a longitudinal axis of the helmet and left and right series of notches provided along said respective left and right elongated slots;

(c) a rear inner pad for facing the back and left and right side regions of the head, said rear inner pad being affixed to said inner surface of said rear shell;

(d) an occipital inner pad located between said rear shell and the occipital region of the head;

(e) a central member extending along the longitudinal axis of said helmet, said central member comprising an upper part that is hingedly mounted with respect to said rear shell and a lower part that is mounted to said occipital inner pad; and (f) left and right wedge members located between said occipital inner pad and said inner surface of said rear shell, said left and right wedge members comprising respective left and right supports and wedgings, said left and right supports having respective left and right protrusions adapted to register with said respective left and right series of notches;

(g) left and right actuators connected to said left and right supports, each left and right actuators being accessible to the wearer for moving each respective left and right wedge members from a first position to a second position wherein, in use, in said first position, said occipital inner pad applies a first pressure upon the occipital region of the head, and in said second position, said occipital inner pad applies a second pressure upon the occipital region of the head, the second pressure being greater than the first pressure.

52. A hockey helmet as defined in claim 51, wherein said left and right actuators are independently movable to allow independent left and right adjustments.

53. A hockey helmet as defined in claim 52, wherein, in use, each of said left and right supports is in a lock position where its protrusions register with its corresponding series of notches for avoiding movement.

54. A hockey helmet as defined in claim 53, wherein said left and right actuators comprise respective left and right biasing elements and left and right buttons, each button being accessible by the wearer.

55. A hockey helmet as defined in claim 54, wherein said left and right actuators comprise respective left and right posts extending through said left and right elongated slots respectively.

56. A hockey helmet as defined in claim 55, wherein in said lock position, each biasing element maintains registering of said protrusions with said notches.

57. A hockey helmet as defined in claim 56, wherein upon pressing of each button by the wearer, each biasing element is compressed and allows disengaging of said protrusions relative to said notches such that movement of corresponding wedge member is possible.

58. A hockey helmet as defined in claim 57, wherein said left and right wedge members each comprise at least one guide bar extending through said left and right elongated slots and left and right receptacles respectively.

59. A hockey helmet as defined in claim 51, wherein said rear shell has a curvature, wherein said occipital inner pad has a rear surface that extends generally perpendicularly about the longitudinal axis of said helmet, wherein each of said left and right wedge members has a front portion contacting said rear surface of said occipital inner pad and wherein movement of each of said left and right wedge members away from said longitudinal axis follows the curvature of said rear shell such that said occipital inner pad moves towards said second position.

60. A hockey helmet as defined in claim 51, wherein said occipital inner pad comprises a rear portion for facing said inner surface of said rear shell and a front portion for facing, in use, the occipital region of the head, wherein said rear portion has a greater rigidity than said front portion.

61. A hockey helmet as defined in claim 51, wherein said central member is integral with said occipital inner pad.

62. A hockey helmet as defined in claim 51, wherein said rear shell comprises an overmolded portion being made of a different material than the rest of said rear shell, and wherein said left and right elongated slots are provided in said overmolded portion.

63. A hockey helmet as defined in claim 51, wherein said occipital inner pad is made of expanded polypropylene (EPP) or expanded polyethylene (EPE) or polyethylene foam.

64. A hockey helmet as defined in claim 63, wherein said occipital inner pad further comprises an occipital comfort liner affixed to an inner surface of said occipital inner pad.

65. A hockey helmet as defined in claim 64, wherein said occipital comfort liner is made of polyvinyl chloride (PVC).

66. A hockey helmet as defined in claim 65, further comprising a front inner pad and a top inner pad affixed on said inner surface of said front shell.

67. A hockey helmet as defined in claim 66, further comprising a rear central inner pad and left and right side inner pads affixed on said inner surface of said rear shell.

68. A hockey helmet as defined in claim 67, further comprising a front comfort liner affixed on an inner surface of said front inner pad and a top comfort liner affixed on an inner surface of said top inner pad.

69. A hockey helmet as defined in claim 68, further comprising left and right side comfort liners affixed on an inner surface of respective said left and right inner pads.

70. A hockey helmet as defined in claim 69, wherein said front shell is movable relative to said rear shell for allowing size adjustment of said helmet.

* * * * *

UNITED STATES PATENT AND TRADEMARK OFFICE

CERTIFICATE OF CORRECTION

PATENT NO. : 7,954,178 B2
APPLICATION NO. : 12/198958
DATED : June 7, 2011
INVENTOR(S) : Jacques Durocher et al.

It is certified that error appears in the above-identified patent and that said Letters Patent is hereby corrected as shown below:

Col. 9
Claim 4, line 22, Delete “post”, and insert -- posts --.

Col. 10
Claim 26, line 44, remove 2nd occurrence of “hockey helmet”.

Col. 11
Claim 36, line 50, Delete “wedgins”, and insert -- wedgings --.

Col. 12
Claim 51, line 60, remove “and”.

Col. 12
Claim 51, line 67, add “and”.

Signed and Sealed this
Ninth Day of August, 2011

David J. Kappos

David J. Kappos
*Director of the United States Patent and Trademark Office*